United States Patent [19]

Forget

[11] Patent Number: 4,614,106

[45] Date of Patent: Sep. 30, 1986

[54] TAB LIFTING AND CRIMPING TOOL

[76] Inventor: Daniel Forget, Unit 11, 2665 Cape Horn Avenue, Coquitlam, British Columbia, V3K 6B8, Canada

[21] Appl. No.: 733,261

[22] Filed: May 13, 1985

Related U.S. Application Data

[63] Continuation-in-part of Ser. No. 595,952, Apr. 2, 1984, abandoned.

[51] Int. Cl.[4] ..... B21D 17/02

[52] U.S. Cl. ..... 72/384; 29/56.6; 29/238; 72/409; 72/442; 81/355

[58] Field of Search ..... 29/56.6, 238, 239, 270, 29/278, 280, 283.5; 81/355, 128; 72/384, 409, 442

[56] References Cited

U.S. PATENT DOCUMENTS

| | | | |
|---|---|---|---|
| 2,572,738 | 10/1951 | Lovinggood | 72/409 |
| 3,180,128 | 4/1965 | Faulkner | 72/409 |
| 3,323,201 | 6/1967 | Fisher | 29/238 |
| 3,705,581 | 12/1972 | Drake | 29/239 |
| 3,742,571 | 7/1973 | Brehm | 29/56.6 |

*Primary Examiner*—W. D. Bray

*Attorney, Agent, or Firm*—D. Ron Morrison

[57] ABSTRACT

A combination tab lifting and crimping tool for lifting and crimping tabs which have been bent over a flange consisting of a casing having a pair of openings at opposite ends thereof and an elongated tool channel therein communicating with the openings. An elongated tool member is slidably mounted the tool channel and has a tab lifting finger proximate a tab lifting end of the casing and a tab crimping face proximate a tab crimping end of same. A flange gripping finger is affixed to the tab crimping end of the casing. A trigger is pivotally mounted in the casing and has a tool engaging end in the interior of the casing coupled to the elongated tool intermediate the tab lifting finger and the tab crimping face.

6 Claims, 6 Drawing Figures

TAB LIFTING AND CRIMPING TOOL

This application is a continuation-in-part of a parent application entitled Tab Lifting Tool and assigned U.S. Ser. No. 06/595,952 filed in the U.S. Patent and Trademark Office on Apr. 2, 1984 and now abandoned.

BACKGROUND OF THE INVENTION

The present invention relates to a tab lifting tool suitable for use on radiators of a type commonly used to cool motor vehicle engine cooling water.

Motor vehicle radiators are commonly made up of a core block consisting of several adjacent thin walled heat conductive tubes extending between top and bottom plastic tanks. Extending around either end of the core block are plates which form part of the core block. These plates have tabs formed around their periphery which are crimped over a flange of a corresponding tank to hold the flange in sealing engagement with a gasket located between the plate and the flange.

Ordinarily, to repair such a radiator it is necessary to first remove the tanks in order to obtain access to the tube ends. Most often implements such as screwdrivers are used to raise the crimped tabs. Such an operation not only often leads to damage of the tanks and/or tabs but is extremely time consuming and tedious. Consequently, it has become commonplace to discard damaged radiators rather than attempting to repair them.

A machine for raising such tabs is disclosed in U.K. patent application GB No. 2,035,168 A, invented by Lawrence Potter and published June 18, 1980. The Potter device has a pair of sturdy elongated jaws or workholders running the length of a tank for gripping the radiator on each side below the tank. A pneumatically operated clamp acts on the top of the tank to constrain the radiator against vertical movement and hold it against the work holders compressing the gasket. A tool with a blade like tip mounted on a slide and moved longitudinally by a motor operated, threaded lead screw engages each tab successively and bends it back to an upright position. Aside from being large, complex and relatively expensive, the Potter machine can not easily lift tabs around the curved ends of the tank. Moreover, with obstructions such as hose connections it is necessary to pivot the tool holder away to clear such obstructions. Finally, the Potter device only lifts tabs; it does not crimp them as well.

U.S. Pat. No. 3,180,128 issued Apr. 27, 1965 to Faulkner discloses a crimping tool having an elongated actuating member slidable in the barrel of the tool and actuated by a pivotally mounted trigger coupled to the actuating member at one end. The Faulkner device is designed to crimp the edges of a panel for an automobile or the like and not for lifting or crimping tabs. Moreover, the Faulkner device is capable only of crimping tabs and would not be adaptable to repairing such items as a radiator, the repair of which generally depends on both lifting and crimping the tabs over a flange.

U.S. Pat. No. 3,742,571 issued July 3, 1973 to Brehm discloses a tool for trimming the ends of wires and inserting them into the terminals of a multi-contact electrical connector. The device includes a reciprocal ram operated by a pivotally mounted trigger, the ram being biased toward a retracted position. An upwardly extending arm contacts one side of the connector while the ram forces the wire into the connector on the other side in response to manual pivotting of the trigger. As in Faulkner, Brehm is not a tool which is adapted to crimping or lifting tabs even though it does disclose the general concept of bracing a tool casing against one side of a work base and forcing a slidable member within the casing against another side of the work base. Since most repair operations involve both lifting and crimping, the known tools are not sufficient to be utilized for the latter purpose.

SUMMARY OF THE INVENTION

According to the invention there is provided a combination tab lifting and crimping tool for lifting and crimping tabs which have been bent over a flange. The tool includes a casing having a pair of openings at opposite ends thereof and an elongated tool channel inside the casing which communicates with the openings. An elongated tool member slidably mounted in the tool channel has a tab lifting finger proximate a tab lifting end of the casing and a tab crimping face proximate a tab crimping end of the casing. A flange gripping finger is affixed to the tab crimping end of the casing while a trigger is pivotally mounted in the casing and has a tool engaging end in the interior thereof coupled to the elongated tool intermediate the tab lifting finger and the tab crimping face thereof.

Biasing means are located in the casing and engage the tool member urging the tab lifting finger thereof away from the casing and the tab crimping face towards the casing. Upon manual pivoting of the trigger the tab crimping face approaches the flange gripping finger for crimping the tab over a flange while the tab lifting finger approaches the opening at the tab lifting end of the casing. By coupling the trigger intermediate the elongated tool member it is possible to incorporate into one tool both a tab lifting and a tab crimping function.

The casing may have a bar slot which communicates with the tool channel and a raised shoulder adjacent the bar slot proximate an end of the bar slot remote from the tab lifting end. A tab bender bar may be affixed to the tool member and project out of the casing through the bar slot slidable from one end of the latter to the other for engaging a tab raised from a flange and crimping it against a flange abutting the shoulder. This feature permits crimping of a tab onto a flange by pressing down directly on the raised end of the tab and juxtaposing the shoulder adjacent an opposite face of the flange to the face upon which the tab is being crimped.

The tab lifting finger may be a depending stub element lcoated at an end of the tool member transverse thereto. The flange gripping finger may be removably remounted in a finger slot in the casing and extend outwardly from the crimping end, terminating in a bent portion for contacting a flange.

The tool member may have affixed a spring contacting element and the biasing means may be a coil spring mounted in the casing and compressed between the spring contacting element coupled to the elongated tool member and the casing.

The implement while adaptable for lifting any type of tab bent over a flange or crimping a lifted tab over a flange, or a substantially right angle surface, is particularly useful for radiators having a core block with plates affixed to either end thereof, bent around a flange and tanks that are adapted to be affixed to either end of the core block. The plates are formed with a series of tabs suitable for bending around the flange of the tanks in order to keep them into sealing contact with the resilient gasket on the underside of the tank.

The invention discloses a single inexpensive tool with a single elongated tool member slidably mounted within a casing and operated by a single trigger which is capable of performing both a tab lifting function as well as a tab crimping function. Moreover, the tab crimping function may operate both on a tab flange assembly wherein the flange has an internal wall which can be engaged by the flange gripping finger of the implement or, where there is no such wall, by engaging the underside of the flange with a flange abutting shoulder of the casing compressing the tab with a tab bender bar also affixed to the elongated tool member. The two tab crimping assemblies and the tab lifting assembly all cooperate with a single tool member which is slidable in response to pivotal movement of a single trigger.

BRIEF DESCRIPTION OF THE DRAWINGS

The invention will now be further described by way of example, with reference to the accompanying drawings, in which.

DETAILED DESCRIPTION WITH REFERENCE TO THE DRAWINGS

Figure 1:
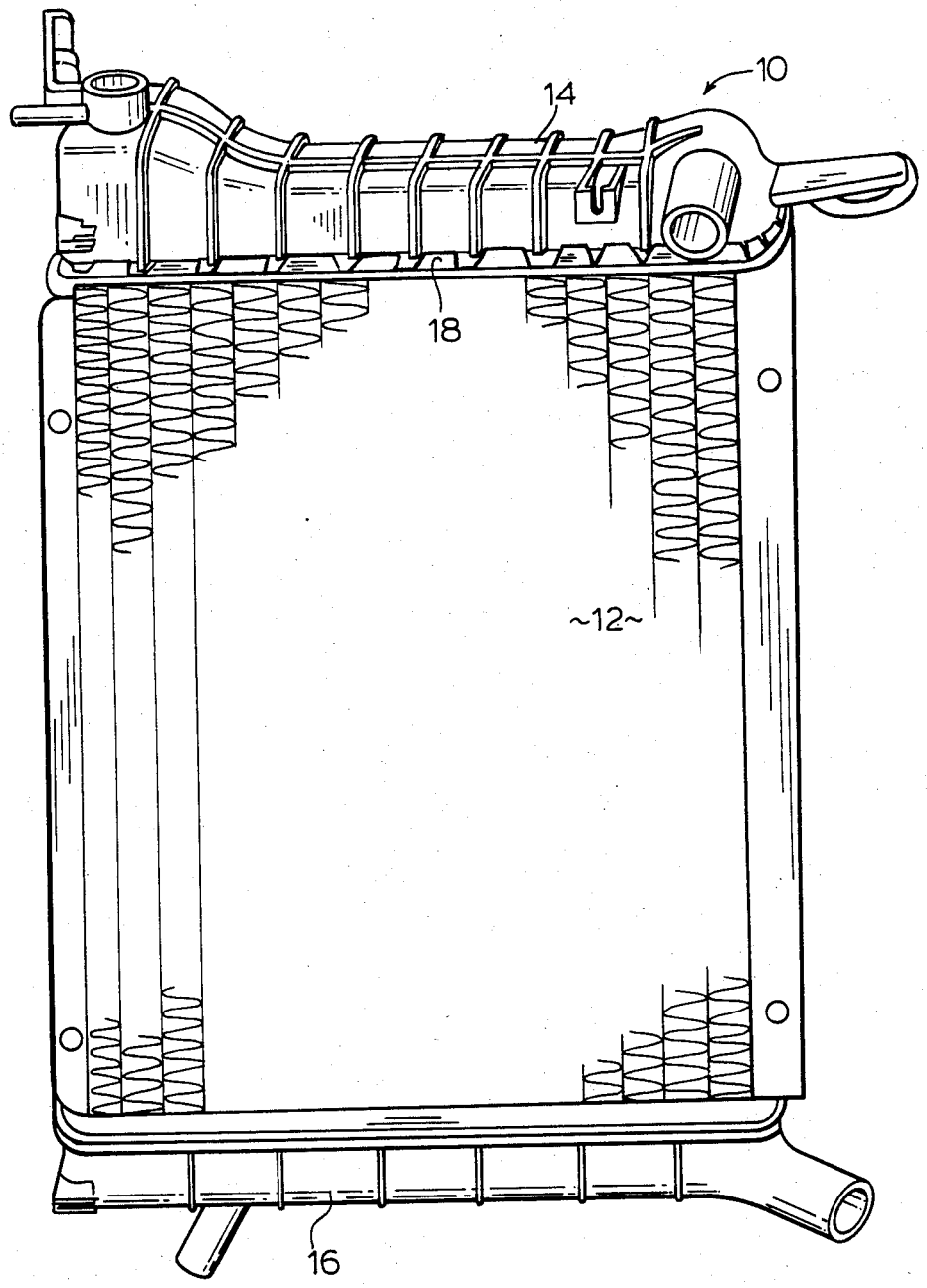
FIG. 1 is a perspective view of a typical radiator to which the present invention is applicable.

The present invention is applicable to a radiator 10 of a type as shown in FIG. 1 which consists of a core block 12 made up of many longitudinally extending bellows-shaped aluminum tubes having their upper ends formed in holes in a tube plate 17 (see FIG. 3) and sealed against radiator fluid leakage by means of a snug fitting passage through a resilient gasket 19 lying flush with and on top of the tube plate 17. The radiator 10 has plastic tanks 14 and 16 mounted on either end thereof and held secure by means of a plurality of tabs 18 bent over a flange 33 on each of the tanks 14 and 16. The tabs 18 keep the bottom of the tank flange 33 in sealing contact with the gasket 19 to effect a water tight seal between the tank 14 and the tube plate 17.

Figure 2:
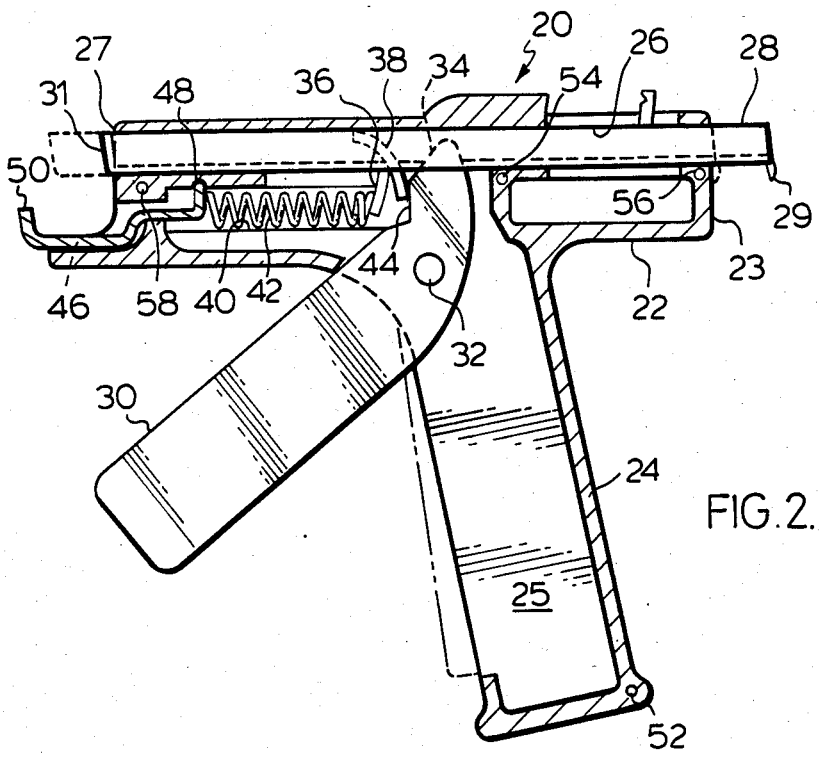
FIG. 2 is a front elevation view of the implement with one half of the casing removed.

The present implement 20 as shown in FIG. 2 provides a means whereby the tabs 18 can be lifted allowing the tank to be removed for access to the gasket 19 and the tube plate 17 for repair.

As shown in FIG. 2 the implement 20 consists of a casing 22 made of two removable halves having an elongated channel 26 therethrough, a trigger handle 24, a trigger chamber 25, a spring chamber 40 and a flange gripping finger slot 48. The moveable parts that are mounted inside the casing 22 consist of an elongated tool member 28 slidable within the channel 26 and having a tab lifting finger 29 at one end and a tab crimping face 31 on the end opposite the tab lifting finger 29. The elongated tool member 28 is mounted so that the tab lifting finger 29 is proximate a tab lifting end 23 of the casing 22 and the tab crimping face 31 is proximate a tab crimping end 27 of the casing 22. A bottom sliding surface of the elongated tool member 28 has a downwardly bent spring stop 36.

A trigger 30 is rotatably mounted about shaft 32 in trigger chamber 25 and has an upper end 34 which extends through a hole in the elongated tool member 28 left by the downwardly bent spring stop 36. The trigger 30 has a contact surface 44 for contacting adaptor piece 38 intermediate the elongated tool member 28 and a contact surface 44. A spring 42 is mounted in the spring chamber 40 and has one end coupled to the spring stop 36 urging the latter toward the tab lifting end 23 of the casing. A flange gripping finger 46 is inserted into slot 48 in the spring chamber 40 and extends outwardly of crimping end 27 and terminates in an upwardly bent finger 50. A plurality of screw holes 52, 54, 56 and 58 are provided to attach the two halves of the casing 22 together. Upon movement of the trigger 30 from the position shown in FIG. 2 in solid lines to that shown in dotted lines, the elongated tool member 28 moves from the position which is shown in solid lines to that shown in dotted lines.

Figure 3:
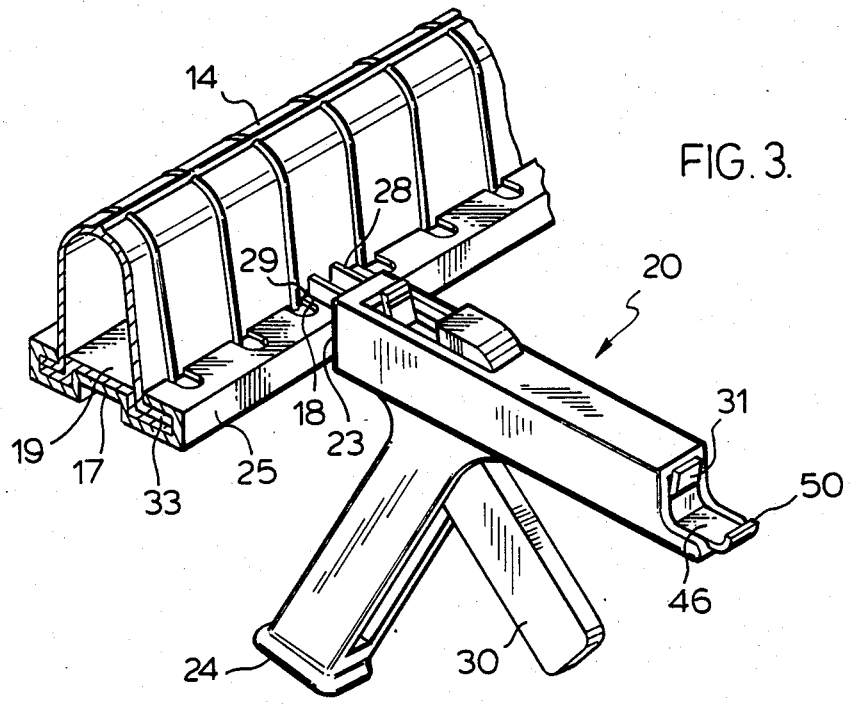
FIG. 3 is a perspective view of the implement operating in the tab lifting mode on a radiator, only a portion of the plastic tank and tabs for which are shown.

FIG. 3 shows the implement 20 as used in raising tabs 18 of a plate 25 that are bent around flange 33 of tank 14. The tab lifting finger 29 of the elongated tool member 28 is inserted between the tank wall 14 and an end of the tab 18. A tab lifting end 23 of the casing 22 abuts the vertical wall 25 of the plate. Trigger 30 is then pushed into trigger chamber 25 contained within trigger housing 24 thereby pulling the tool member 28 back into the casing 20. This force results in lifting of the tab 18 into an upright position. This procedure is repeated for each tab in succession until all of the tabs are in an upright position. Once all of the tabs have been lifted, the tank 14 can easily be removed thereby permitting access to the resilient seal 19 and the tube plate 17.

Figure 4:
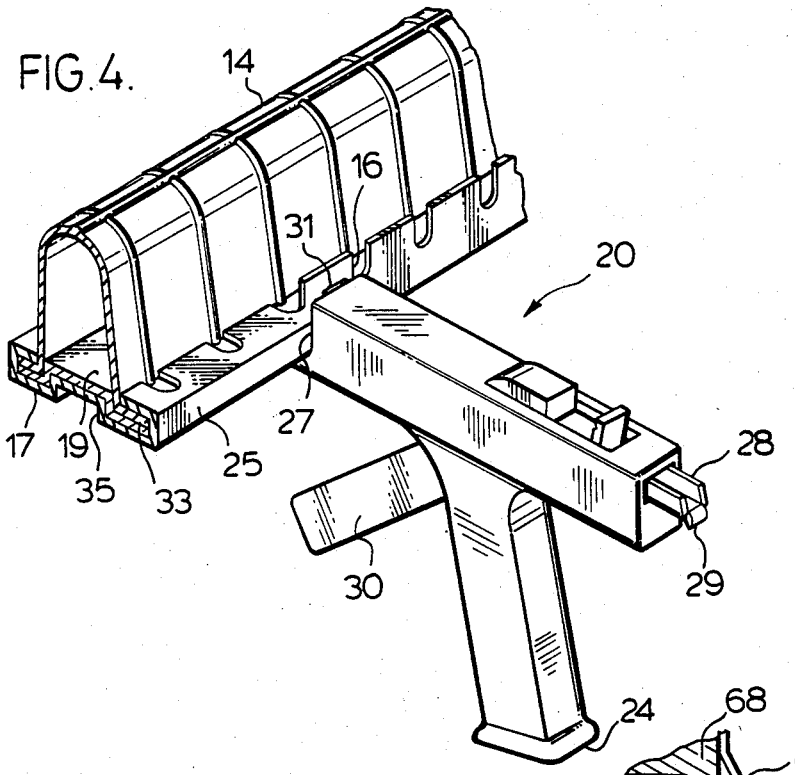
FIG. 4 is a perspective view of the implement operating in the tab crimping mode on a radiator, only a portion of which is shown.

Once the radiator has been repaired, the tank is put back into place on top of the resilient seal 19. As shown in FIG. 4, the implement 20 is then positioned so that the bent portion 50 of its flange gripping finger 46 contacts interior wall 35. Upon squeezing trigger 30, elongated tool member 28 moves so that the tab crimping end 31 pushes the tab onto the flange 33 of the tank 14. This procedure is again repeated until all of the tabs have been pressed onto the flange, thereby completing repair of the radiator.

Figure 5:
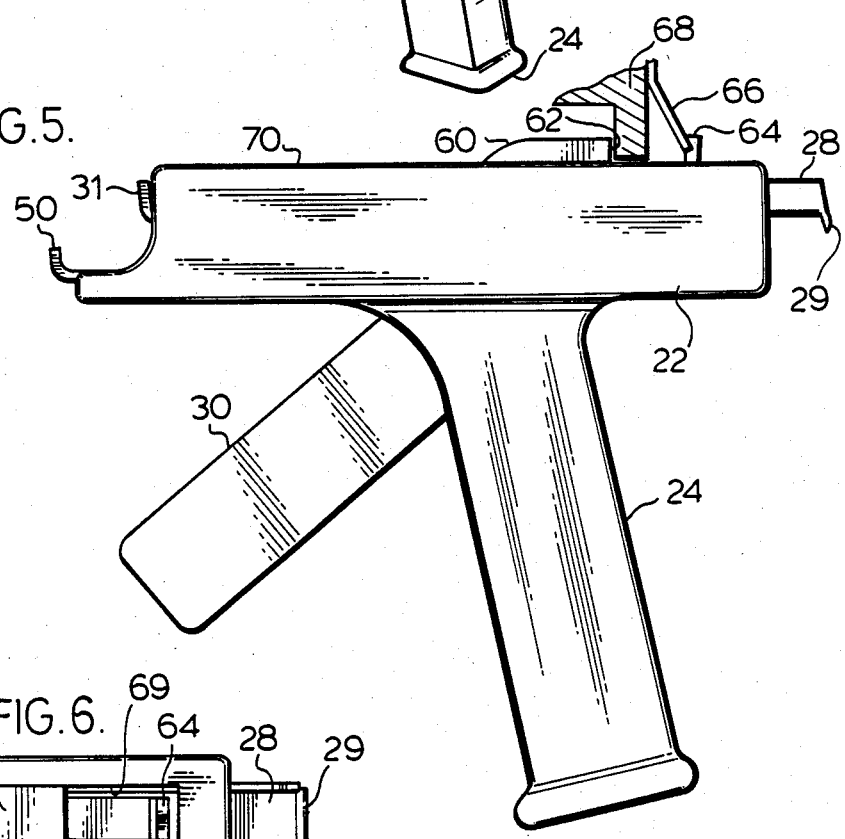
FIG. 5 is a front elevation view of a variant of the implement.
Figure 6:
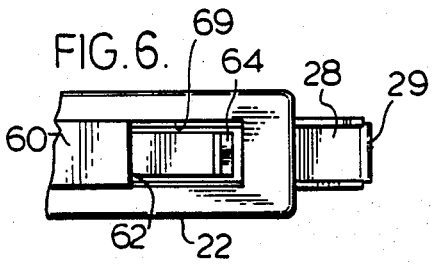
FIG. 6 is a plan view of a rear portion of the variant of FIG. 5.

A variant of the implement shown in FIGS. 5 and 6 includes a raised casing portion 60 along a casing barrel 70 having a flange abutting shoulder 62. A tab bender bar 64 integral with the elongated tool member 28 is movable along a bar slot 69 in the casing barrel 70 from a position remote from shoulder 62 to a position adjacent the latter in response to pivotal movement of trigger 30 into housing 24.

In operation, shoulder 62 is positioned abutting a flange 68 while bar 64 contacts a raised tab 66. Depression of trigger 30 causes bar 64 to move toward shoulder 62 and bend tab 66 to a flat position onto flange 68.

Other variations, modifications and departures lying within the spirit of the invention and scope as defined by the appended claims will be obvious to those skilled in the art.

I claim:

1. A combination tab lifting and crimping tool for lifting and crimping tabs which have been bent over a flange, comprising:

(a) a casing having a pair of openings at opposite respective tab lifting and tab crimping ends thereof and an elongated tool channel therein communicating with the openings;

(b) an elongated tool member slidably mounted in said tool channel having thereon a tab lifting finger proximate said tab lifting end of said member and casing and a tab crimping face proximate said tab crimping end of said member and casing:

(c) a flange gripping finger affixed to the tab crimping end of said casing;

(d) a trigger pivotally mounted in said casing and having a tool engaging end in the interior of said casing coupled to said elongated tool intermediate said tab lifting finger and tab crimping face thereof; and (e) biasing means located in said casing and engaging said tool mamber urging the tab lifting finger thereof away from said casing and said tab crimping face thereof towards said casing;

wherein upon manual pivoting of said trigger said tab crimping face approaches said flange gripping finger for crimping a tab over a flange and said tab lifting finger approaches the opening at the tab lifting end of said casing.

2. A tool as in claim 1, wherein said casing has a bar slot therein communicating with the tool channel, a raised shoulder adjacent said bar slot proximate an end thereof remote from said tab lifting end and a tab bender bar affixed to said tool member projecting out of said casing and slidable from one end of the bar slot to the other for engaging a tab raised from a flange and crimping it against a flange abutting said shoulder.

3. A tool as in claim 1, wherein said tab lifting finger is a depending stub element located at an end of said tool member transverse thereto.

4. A tool as in claim 3, wherein said flange gripping finger is removably mounted in a finger slot in said casing and extends outwardly from the crimping end terminating in a bent portion for contacting a flange.

5. A tool as in claim 4, wherein said tool member has affixed a spring contacting element and said biasing means is a coil spring mounted in said casing compressed between the spring contacting element coupled to said elongated tool member and said casing.

6. A combination tab lifting and crimping tool for lifting and crimping tabs which have been bent over a flange, comprising:

(a) A casing having a pair of openings at opposite respective tab lifting and tab crimping ends thereof and an elongated tool channel therein communicating with the opening;

(b) an elongated tool member slidably mounted in said tool channel having thereon a tab lifting finger proximate a tab lifting end of said member and casing and a tab crimping face proximate a tab crimping end of said member and casing;

(c) a flange gripping finger affixed to the tab crimping end of said casing;

(d) a trigger pivotally mounted in said casing and having a tool engaging end in the interior of said casing coupled to said elongated tool intermediate said tab lifting finger and tab crimping face thereof;

(e) biasing means located in said casing and engaging said tool member urging the tab lifting finger thereof away from said casing and said tab crimping face thereof towards said casing, wherein upon manual pivoting of said trigger said tab crimping face approaches said flange gripping finger for crimping a tab over a flange and said tab lifting finger approaches the opening at the tab lifting end of said casing; and (f) a bar slot in said casing communicating with the tool channel, a raised shoulder on said casing adjacent said bar slot proximate an end thereof remote from said tab lifting end and a tab bender bar affixed to said tool member projecting out of said casing and slidable from one end of the bar slot to the other for engaging a tab raised from a flange and crimping it against a flange abutting said shoulder.

* * * * *